US005990602A

United States Patent [19]

Katoh et al.

[11] Patent Number: 5,990,602

[45] Date of Patent: Nov. 23, 1999

[54] LONG LIFE SPARK PLUG HAVING MINIMUM NOBLE METAL AMOUNT

[75] Inventors: Akio Katoh, Nishio; Keiji Kanao, Nagoya, both of Japan

[73] Assignee: Nippondenso Co., Ltd., Kariya, Japan

[21] Appl. No.: 08/068,700

[22] Filed: May 28, 1993

[30] Foreign Application Priority Data

Jun. 1, 1992 [JP] Japan ..... 4-167033

[51] Int. Cl.[6] ..... H01T 13/20

[52] U.S. Cl. ..... 313/141

[58] Field of Search ..... 313/141, 142

[56] References Cited

U.S. PATENT DOCUMENTS

| | | | |
|---|---|---|---|
| 4,109,633 | 8/1978 | Mitsudo et al. | 313/141 |
| 4,331,899 | 5/1982 | Nishida et al. | 313/142 |
| 4,540,910 | 9/1985 | Kondo et al. | 313/142 |
| 4,581,558 | 4/1986 | Takamura et al. | 313/142 |
| 4,670,684 | 6/1987 | Kagawa et al. | 313/142 |
| 4,700,103 | 10/1987 | Yamaguchi et al. | 313/142 |
| 4,893,051 | 1/1990 | Kondo | 313/141 |
| 5,159,232 | 10/1992 | Sato et al. | 313/142 |
| 5,179,313 | 1/1993 | Eves et al. | 313/141 |
| 5,202,601 | 4/1993 | Takamura et al. | 313/142 |
| 5,273,474 | 12/1993 | Oshima et al. | 313/141 |

FOREIGN PATENT DOCUMENTS

| | | | |
|---|---|---|---|
| 36237 | 3/1977 | Japan | 313/142 |
| 58-31687 | 3/1983 | Japan . | |
| 63-62870 | 12/1988 | Japan . | |
| 17491 | 1/1989 | Japan | 313/142 |
| 1319284 | 12/1989 | Japan . | |
| 201384 | 9/1991 | Japan | 313/141 |

*Primary Examiner*—Sandra O'Shea
*Attorney, Agent, or Firm*—Pillsbury Madison & Sutro LLP

[57] ABSTRACT

An economical spark plug for an internal combustion engine which has a long service life and by which a reduction in the discharge voltage and the use of the minimum amount of a noble metal can be achieved. The spark plug has an insulator, a center electrode supported by the insulator, and an earth electrode facing to the center electrode. A narrowed portion is arranged on a tip of an electrode material of at least one of the center electrode and the earth electrode. The narrowed portion includes a projection formed by extending the electrode material and a noble metal chip firmly connected to a terminal end of the projection. The electrode material is a nickel-base heat-resisting alloy. The noble metal chip is made of a Pt—Ir alloy essentially consisting of 90–100% by weight Pt and 0–10% by weight Ir. A diameter D of the narrowed portion is in a range of 0.6–1.2 mm. A thickness t of the noble metal chip is in a range of 0.16–0.8 mm. A length L of the narrowed portion including the thickness t of the noble metal chip is in a range of 0.8–1.5 mm.

2 Claims, 8 Drawing Sheets

LONG LIFE SPARK PLUG HAVING MINIMUM NOBLE METAL AMOUNT

BACKGROUND OF THE INVENTION

1. Field of the Invention

The present invention relates to a spark plug for an internal combustion engine provided with a noble metal chip in an ignition section.

2. Description of the Related Art

These days, engines are becoming of more and more high performance, of supercharging design, and adapted to be of a lean-burn type and have higher compression ratios, and accordingly, an increase in the discharge voltage of a spark plug is unavoidable, which might result in the risk of exceeding the voltage generated at power source. Further, engines free from maintenance are coming into great demand, and it is also highly demanded that the life of the spark plugs be prolonged.

Conventionally, in order to satisfy a reduction in the discharge voltage and an increase in the life of the spark plugs as stated above, a spark plug has been proposed in Japanese Patent Publication No. 63-62870. Such a spark plug is constructed such that an elongated bar-shaped noble metal chip which is extremely excellent in wear-resisting properties is attached to a tip of an electrode material forming at least one of a center electrode and an earth electrode.

Such a noble metal chip is made of a Pt—Ir alloy essentially consisting of 70–90% platinum and 30–10% iridium, or a Pt—Ni alloy essentially consisting of 80–90% platinum and 20–10% nickel. The electrode material is made of a nickel-base heat-resisting alloy.

When the noble metal chip is secured to the tip of the electrode material as stated above, a recess which is slightly wider than the diameter of the noble metal chip is first formed on the tip of the center electrode, and then, the noble metal chip is fit into such a recess. Subsequently, they are pressed, and also welded by using a laser or an electron beam, or the like, whereby an end of the noble metal chip is expended to have the shape of a flange and firmly welded to the recess of the center electrode.

The noble metal chip uses expensive materials such as a Pt—Ir alloy or a Pt—Ni alloy. However, a large portion of the noble metal chip has to be disposed of, although it is intact, when the life of the spark plug comes to an end.

More specifically, only a small portion of the noble metal chip wears due to discharge voltage. However, when a spark gap exceeds a predetermined size (the gap size occurring when the discharge voltage exceeds the voltage generated at power source), that is, when the life of the spark plug comes to an end, a large portion of the noble metal chip has to be disposed of together with the spark plug. This is undesirable not only for economical reasons but also from the respect of protecting the natural environment.

Also, there is a big difference between the coefficient of linear expansion of the noble metal chip and that of a Nickel-base heat-resisting alloy composing the electrode material.

Thus, after the spark plug is used in an engine at a high temperature over a long period, a crack 91 might occur due to thermal stress at a noble metal chip 9 developed in the vicinity of a contact surface 98 between an electrode material 8 and the noble metal chip 9, as illustrated in FIG. 13. When the crack 91 becomes greater, there is caused such a risk that the noble metal chip 9 will peel and fall off from the electrode material 8, as shown in FIG. 14.

Further, when a cooling load is applied to the engine at a high temperature, tensile stress is produced in the electrode material having the greater coefficient of linear expansion due to the thermal stress during cooling. At this time, a swelling 83 is caused at the electrode material 8 due to plastic deformation, as illustrated in FIG. 15. Such a swelling 83 is further expanded by repeating the application of the cooling load.

Moreover, stress corrosion occurs at the electrode material due to such an excessive stress, and when the corrosion is extremely aggravated, the noble metal chip might peel and fall off as shown in FIG. 14, which results in shortening the life of the spark plug.

SUMMARY OF THE INVENTION

In view of the foregoing problems, an object of the present invention is to provide an economical spark plug for an internal combustion engine which has a long service life, and by which a reduction in the discharge voltage and the use of very little amount of a noble metal can be achieved.

To achieve the above object, the present invention provides a spark plug for an internal combustion engine comprising: an insulator; a center electrode supported by the insulator; a housing secured around an outer periphery of the insulator; an earth electrode arranged on the housing and facing to the center electrode; and a narrowed portion disposed on a tip of an electrode material forming at least one of the center electrode and the earth electrode, the narrowed portion including a projection formed by extending the electrode material and a noble metal chip firmly connected to a terminal end of the projection; wherein the electrode material is formed of a nickel-base heat-resisting alloy, and wherein the noble metal chip is formed of a platinum-iridium alloy essentially consisting of 90–100% Pt (% is indicated by weight as are the following) and 0–10% Ir, or formed of an alloy obtained by dispersing 0.01–2% zirconia ($ZrO_2$) or yttria ($Y_2O_3$) in the Pt—Ir alloy of 99.99–98%; and wherein a diameter D of the narrowed portion is between 0.6 and 1.2 mm, and a length L of the narrowed portion including a thickness t of the noble metal chip is between 0.8 and 1.5 mm, and the relationship among the thickness t, the diameter D and the length L is as follows;

$0.4L \leqq t \leqq 0.8$ mm when $0.6$ mm $\leqq D < 0.8$ mm $0.3L \leqq t \leqq 0.8$ mm when $0.8$ mm $\leqq D < 1.0$ mm $0.2L \leqq t \leqq 0.8$ mm when $1.0$ mm $\leqq D \leqq 1.2$ mm.

The most remarkable characteristics of the present invention are the configuration of the narrowed portion formed of the electrode material and the noble metal chip as explained above, and the compositions of the electrode material and the noble metal chip.

In the present invention, the noble metal chip is secured to the tip of the narrowed portion of the electrode material forming at least one of the center electrode and the earth electrode.

The noble metal chip is formed of 90–100% Pt and 0–10% Ir, that is, a Pt—Ir alloy or pure platinum. When the amount of Ir exceeds 10%, an increase in the amount of wear of the noble metal chip caused by spark discharge is detected, and accordingly the life of the spark plug is shortened (See FIG. 7).

The noble metal chip is preferably formed of a dispersion-strengthened alloy essentially consisting of the Pt—Ir alloy of 99.99–98% and 0.01–2% zirconia or yttria, thereby reducing the amount of wear of the noble metal chip caused by spark discharge and increasing the strength of the noble metal chip (See FIGS. 7 and 8).

In the present invention, the length L of the narrowed portion including the noble metal chip is between 0.8 and 1.5 mm.

If the length L is less than 0.8 mm, the advantage of reducing the discharge voltage cannot be obtained. On the other hand, if the length L is more than 1.5 mm, heat conduction transferred to the center electrode deteriorates, and thus a thermal load applied to the projection increases. Therefore, the projection is exposed to a very harsh temperature atmosphere during operation of the engine, thus resulting in shortening the usable period of the spark plug. The length L is preferably between 0.9 and 1.3 mm.

The diameter D of the narrowed portion is between 0.6 and 1.2 mm.

If the diameter D is less than 0.6 mm, spark discharge spreads over the discharge area of the cathode during induction discharge, thereby causing spark wear to the projection of the narrowed portion, which further results in the risk of the noble metal chip peeling and falling off.

On the other hand, when the diameter D exceeds 1.2 mm, the advantage of reducing the discharge voltage cannot be obtained.

Also, in this case, a crack is likely to occur at the noble metal chip. More specifically, when the spark plug is heated, the noble metal chip having a smaller coefficient of linear expansion is subjected to a tensile stress coming from the electrode material having a greater coefficient of linear expansion. The stress tends to increase more when the contact area between the noble metal chip and the projection becomes greater.

Hence, if the diameter D of the narrowed portion is more than 1.2 mm, a crack is very apt to occur at the noble metal chip due to an increase in the stress applied from the projection to the noble metal chip.

The diameter D is preferably between 0.7 and 1.1 mm.

The relationship among the diameter D and the length L of the narrowed portion, and the thickness t of the noble metal chip is $0.4L \leqq t \leqq 0.8$ mm when D is 0.6 mm or greater and less than 0.8 mm, $0.3L \leqq t \leqq 0.8$ mm when D is 0.8 mm or greater and less than 1.0 mm, and $0.2L \leqq t \leqq 0.8$ mm when D is 1.0 mm or greater and is 1.2 mm or less.

When t exceeds 0.8 mm, stress corrosion is apt to occur at the electrode material (See FIG. 10). That is, the electrode material is subjected to tensile stress from the noble metal chip produced during cooling as stated above, and thus a swelling is caused in the vicinity of the contact surface between the electrode material and the noble metal chip. Such a swelling is expanded by repeating the application of a cooling load, and when the swelling is further expanded to an extreme degree, a crack occurs at the electrode material.

On the other hand, when t becomes smaller, the strength of the noble metal chip is lowered, and accordingly, a crack is apt to occur at the noble metal chip, which might result in the risk of the noble metal chip peeling and falling off when the crack is extremely great.

The minimum value of the thickness t of the noble metal chip varies depending on the value of the diameter D of the narrowed portion.

More specifically, when D becomes greater, the contact area between the noble metal chip and the projection accordingly becomes greater, and thus the stress produced at the noble metal chip is apt to increase as previously discussed. On the other hand, since heat conduction is improved, the temperature of the narrowed portion is lowered, and thus the stress tends to decrease. As a result, the minimum value t is determined by the balance of such conflicting tendencies.

When D is within a range of between 0.6 and 1.2 mm, the advantage of lowering the temperature brought about heat conduction is very effective, and the minimum value t is lowered as D increases.

More specifically, when D is 0.6 mm or greater and less than 0.8 mm and t is less than 0.4L, the strength of the noble metal chip is too insufficient to cope with the above-mentioned stress. Thus, a crack occurs at the noble metal chip, which might be even fallen off as explained above.

Also, when D is 0.8 mm or greater and less than 1.0 mm and t is less than 0.3L, or D is 1.0 mm or greater and 1.2 mm or less and t is less than 0.2L, a similar phenomenon occurs.

It is preferable that a discharge layer be secured to the tip of the narrowed portion of the electrode material. The discharge layer comprises the noble metal chip disposed on the discharge side and a relaxing layer disposed on the side of the projection.

The relaxing layer is formed of a Pt—Ni alloy essentially consisting of 70–90% Pt and 10–30% Ni. When the composition of Pt and Ni is within the above-mentioned range, the coefficient of linear expansion of the relaxing layer is between those of the noble metal chip and the projection, the stresses of which can thus be relaxed by the relaxing layer caused during the cooling and heating load. Hence, cracks and stress corrosion can be prevented at both the noble metal chip and the projection, and consequently, the spark plug can be used over a longer period.

The thickness S of the relaxing layer is preferably 0.05 mm or greater. The relaxing layer having a thickness S of less than 0.05 mm cannot fully relax the stresses between the noble metal chip and the electrode material. The thicker the thickness S, the greater the effect of relaxing the stresses. However, when S exceeds 0.5 mm, a remarkable effect is no longer obtained in proportion to the thickness S. Since the relaxing layer is also formed of a noble metal, the upper limit of the thickness thereof is preferably 0.5 mm for economical reasons.

Further, the relationship between the length L of the narrowed portion and the thickness T of the discharge layer is preferably $0.2L \leqq T \leqq L$. If T is less than 0.2L, the relaxing layer cannot fully relax the stresses between the noble metal chip and electrode material. If T exceeds L, the expensive noble metal chip is only wasted needlessly.

The thickness T of the discharge layer is the total of the thickness t of the noble metal chip and the thickness S of the relaxing layer.

In the present invention, the compositions of the electrode material and the noble metal chip are within the ranges as previously discussed. Thus, there is little amount of wear of the noble metal chip caused by spark discharge (See FIG. 7). As a result, the service life of the spark plug is prolonged, and accordingly, the spark plug can be used over a long period.

Moreover, the thickness t of the noble metal chip and the diameter D and the length L of the narrowed portion are within the ranges as previously discussed. Thus, the discharge voltage can be extremely reduced, and also the amount of wear and the use of the noble metal chip can be minimized. Further, the narrowed portion having the configuration as stated above can fully withstand the harsh temperature atmosphere during operation of the engine as previously explained in detail.

Accordingly, the present invention can provide a very economical spark plug for an internal combustion engine which has a long life, and by which a remarkable reduction in the discharge voltage and the efficient use of a noble metal without waste can be achieved.

DESCRIPTION OF THE PREFERRED EMBODIMENTS

EXAMPLE 1

Figure 1:
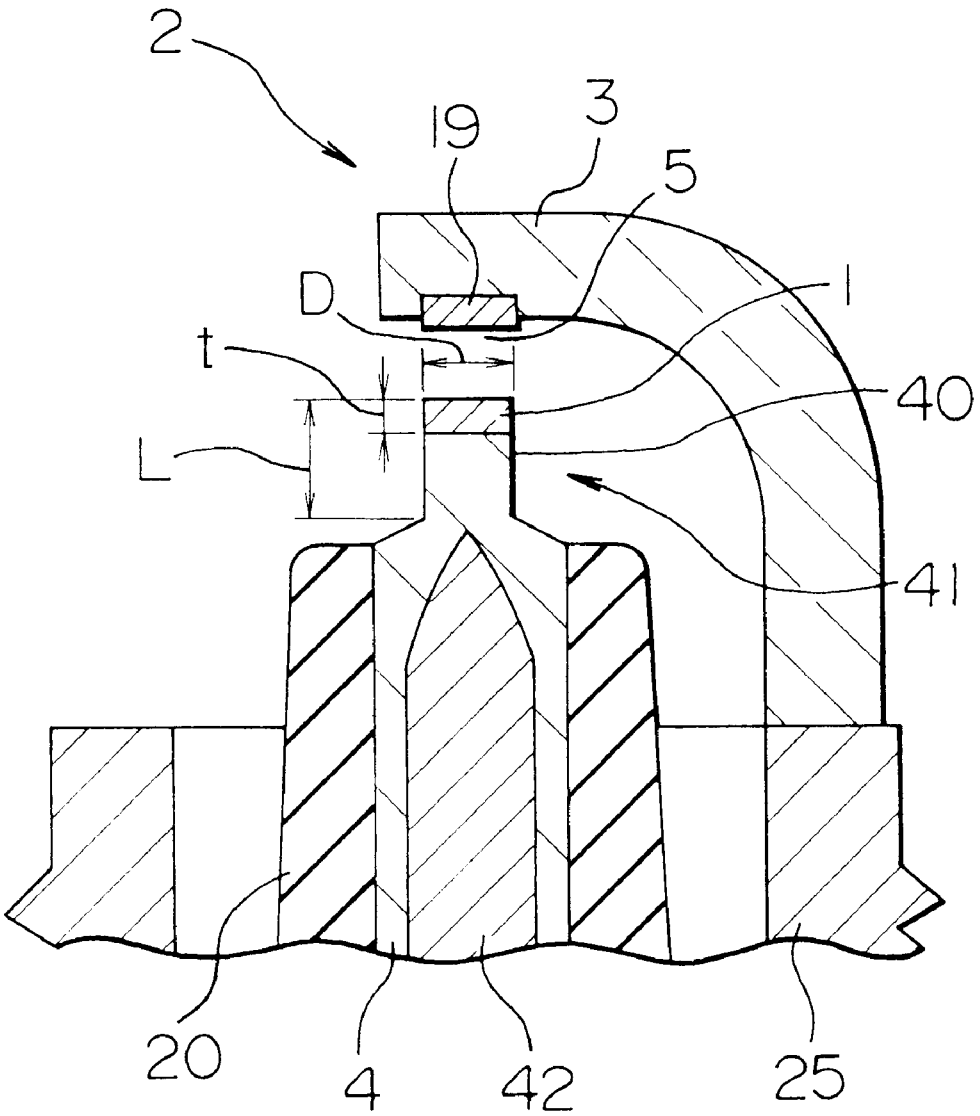
FIG. 1 is an expanded sectional view of an essential portion of a spark plug according to Example 1.
Figure 2:
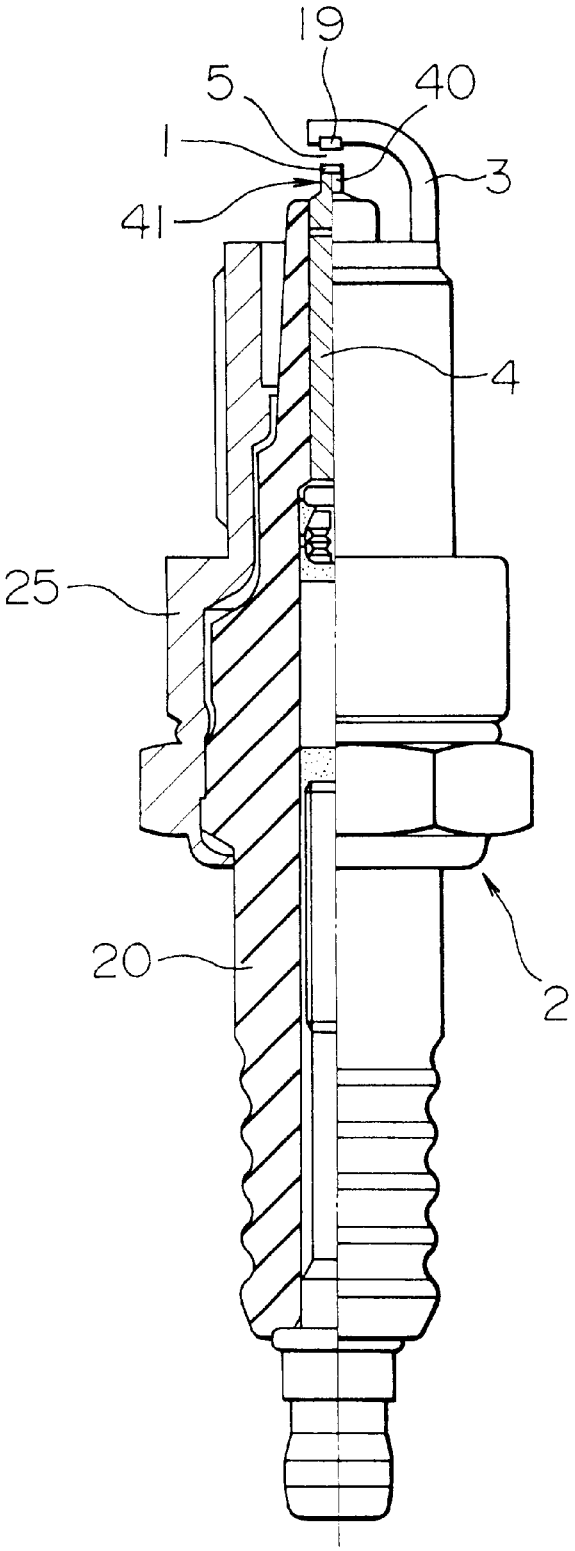
FIG. 2 is a partially side sectional view of the spark plug according to Example 1.
Figure 3:
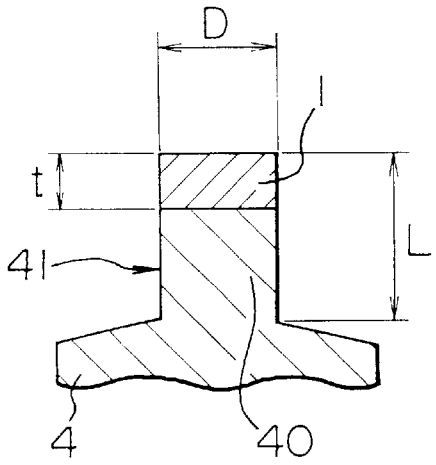
FIG. 3 is a sectional view of a narrowed portion according to Example 1.

Reference will first be made to FIGS. 1–3 to describe an embodiment of the present invention. A spark plug 2 for an internal combustion engine according to the present invention includes an insulator 20, a center electrode 4 supported by the insulator 20, a housing 25 secured around the outer periphery of the insulator 20, and an earth electrode 3 mounted on the housing 25 and facing to the center electrode 4 with an intervening gap for spark discharge 5.

A narrowed portion 41 comprising a noble metal chip 1 and a projection 40 of the center electrode 4 is arranged on the tip of the center electrode 4. The center electrode 4 is cathode.

The projection 40 is formed by extending the center electrode 4.

The center electrode 4 and the earth electrode 3 are formed of an electrode material using a nickel-base heat-resisting alloy. A copper material 42 is filled in the center electrode 4 for improving the conductivity of the center electrode 4.

The noble metal chip 1 formed of an alloy essentially consisting of a 95% Pt—5% Ir alloy is mounted on the top end of the projection 40.

In this example, the narrowed portion 41 has a diameter D of 0.9 mm. The length L (including the noble metal chip 1) of the narrowed portion 41 and the thickness of the noble metal chip 1 are within the aforementioned preferred ranges for those dimensions.

Another noble metal chip 19 is secured to an end of the earth electrode 3.

The spark discharge occurs at the gap 5 between the noble metal chips 1 and 19.

In this example, since the amount of wear caused by the spark discharge of the noble metal chip 1 is little, the service life of the spark plug 2 is prolonged, and thus the spark plug 2 can be used over a long period.

The relationship among the thickness t of the noble metal chip 1, the diameter D and the length L of the narrowed portion 41 is as previously discussed. Thus, the discharge voltage can be substantially reduced, and the wear and the use of the noble metal chip 1 can also be minimized. Further, the narrowed portion 41 having the shape described above is able to fully withstand even the harsh temperature atmosphere during operation of the engine.

EXAMPLE 2

An electrode material of a spark plug according to the present example is formed of a dispersion-strengthened alloy obtained by adding 0.1% zirconia or yttria to the Pt—Ir alloy of 99.9% used in Example 1.

The other conditions are similar to those of Example 1.

According to this example, the strength of the noble metal chip 1 is improved, and the wear of the electrode material of the projection 40 is even more reduced, and thus the spark plug can be used over a long period.

Also, advantages similar to those of Example 1 can be obtained.

EXAMPLE 3

Figure 4:
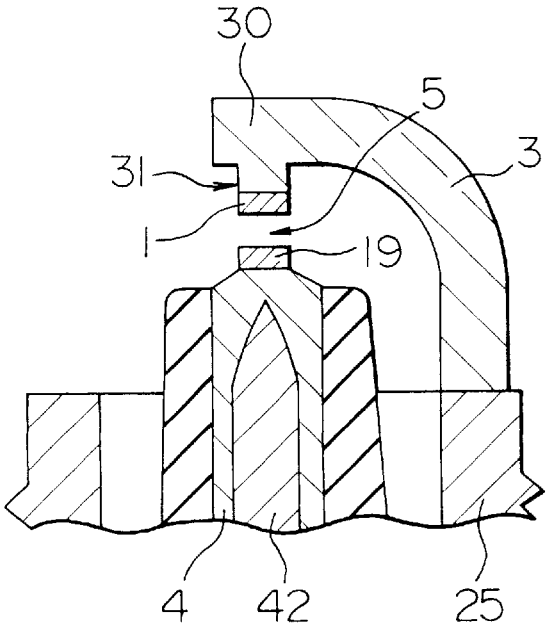
FIG. 4 is an expanded sectional view of an essential portion of a spark plug according to Example 3.

In this example, instead of disposing the narrowed portion 41 on the tip of the center electrode 4 as shown in Example 1, a narrowed portion 31 is arranged at the tip of the earth electrode 3, as shown in FIG. 4. The earth electrode 3 is cathode and the center electrode 4 is anode.

The narrowed portion 31 comprises a projection 30 formed by extending the earth electrode 3 and the noble metal chip 1 secured to the tip of the projection 30.

The spark discharge occurs at the gap 5 between the noble metal chips 1 and 19.

The other conditions are similar to those of Example 1.

Advantages similar to those of Example 1 can also be obtained in this example.

EXAMPLE 4

Figure 5:
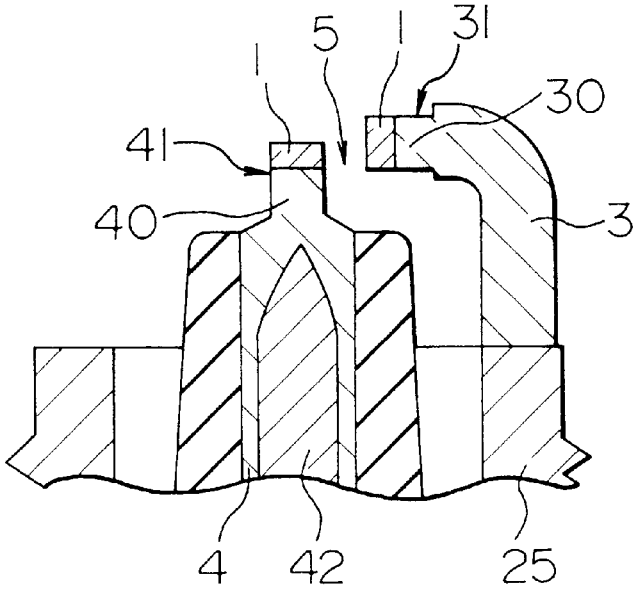
FIG. 5 is an expanded sectional view of an essential portion of a spark plug according to Example 4.

In this example, the earth electrode 3 extends lateral to the tip of the center electrode 4, and both the center electrode 4 and the earth electrode 3 are provided with the narrowed portions 41 and 31, as illustrated in FIG. 5.

The narrowed portion 31 comprises the projection 30 formed by extending the earth electrode 3 and the noble metal chip 1 secured to the tip of the projection 30.

The other conditions are similar to those of Example 1.

Advantages similar to those of Example 1 can also be obtained in this example.

EXAMPLE 5

Figure 6:
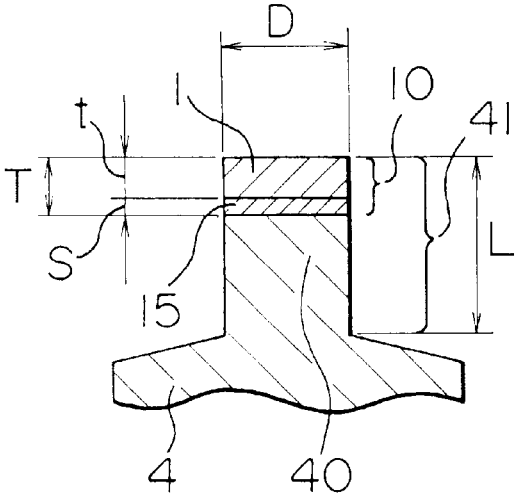
FIG. 6 is a sectional view of a narrowed portion according to Example 5.

In this example, the narrowed portion 41 is arranged on the center electrode 4, as shown in FIG. 6. The narrowed portion 41 comprises the projection 40 and a discharge layer 10 mounted on the tip of the projection 40. The discharge layer 10 is formed of the noble metal chip 1 disposed on the discharging side and a relaxing layer 15 disposed on the side of the projection 40. The relationship between the length L of the narrowed portion 40 and the thickness T of the discharge layer 10 is $0.2L \leqq T \leqq L$. More specifically, T is 0.4 mm and L is 1.2 mm.

The relaxing layer 15 is formed of a Pt—Ni alloy essentially consisting of 80% Pt and 20% Ni. The thickness S of the relaxing layer is 0.06 mm.

The other conditions are similar to those of Example 1.

This example differs from the previous examples in that the relaxing layer 15 is arranged, which functions to relieve the stress of both the noble metal chip 1 and the projection 40 produced during the cooling load. Thus, the noble metal chip 1 and the projection 40 can be protected from the occurrence of cracking and stress corrosion, and accordingly, the spark plug can be used over a long period.

Advantages similar to those of Example 1 can also be obtained in this example.

EXAMPLES 6 and 7

In the spark plugs in the present examples, the amount of iridium contained in the Pt—Ir alloy and the dispersion-strengthened alloy used for the noble metal chip was varied, whereby an evaluation test was performed by employing spark discharge on the wear resisting properties and the strength of the noble metal chips.

For producing a spark plug in Example 6, the metal noble chip formed of the Pt—Ir alloy obtained by varying the amount of iridium contained in the alloy was welded to the tip of the center electrode of the spark plug (PK20R made by Nippondenso Co., Ltd.).

The narrowed portion has a diameter D of 0.8 mm, a length L of 1.3 mm, and the noble metal chip has a thickness t of 0.5 mm. The electrode material is formed of a Ni-base heat-resisting alloy essentially consisting of Ni, Cr, Fe, Al or the like. It should be noted that the center electrode is cathode and the earth electrode is anode, and that the former is exposed to a harsher temperature atmosphere than the latter.

The other conditions are similar to those of Example 1.

On the other hand, for producing another spark plug in Example 7, the noble metal chip formed of a dispersion-strengthened alloy obtained by varying the amount of iridium contained in the alloy was welded to the tip of the center electrode. The dispersion-strengthened alloy is obtained by adding zirconia or 0.1% yttria to the Pt—Ir alloy of 99.9%. The other conditions are similar to those of Example 6.

Under the test conditions stated above, the spark plugs were spark-discharged in the atmosphere at 60 times per second for 400 hours in a chamber pressurized at 4 $kg/cm^2$ gauge.

Figure 7:
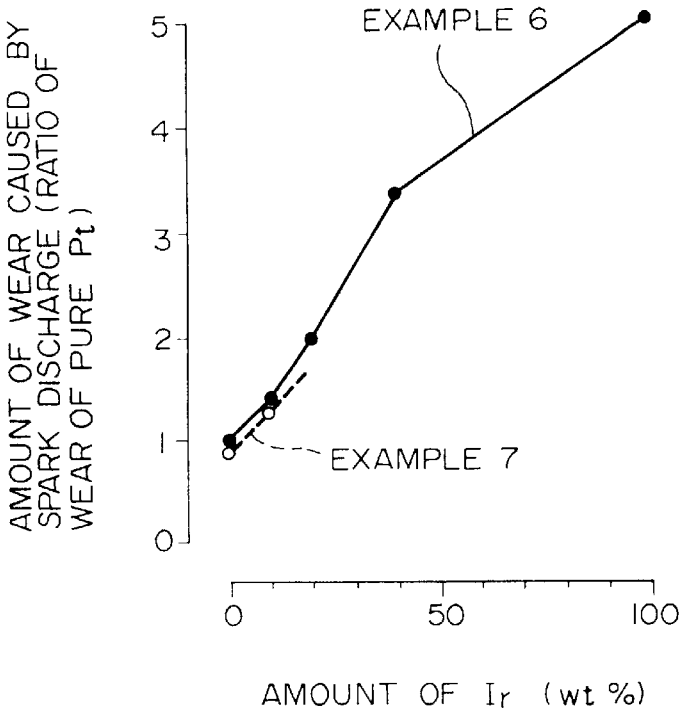
FIG. 7 is a graph indicating the relationship between the amount of iridium contained in noble metal chips and the amount of wear of the noble metal chips caused by sparking according to Examples 6 and 7.

As a result of the test, the amount of wear of the noble metal chips is shown in FIG. 7. Referring to FIG. 7, the horizontal axis represents the iridium amount (% by weight) contained in the noble metal chip and the vertical axis indicates the amount of wear of the noble metal chip caused by the spark discharge. The value of the amount of wear is indicated when that of the noble metal chip containing 100% Pt (0% Ir) is 1.

Subsequently, the strength of the various noble metal alloys used in Examples 6 and 7 was evaluated. The noble metal chip test piece having a diameter D of 3 mm and a length L of 50 mm was evaluated by employing an ordinary tensile tester.

Figure 8:
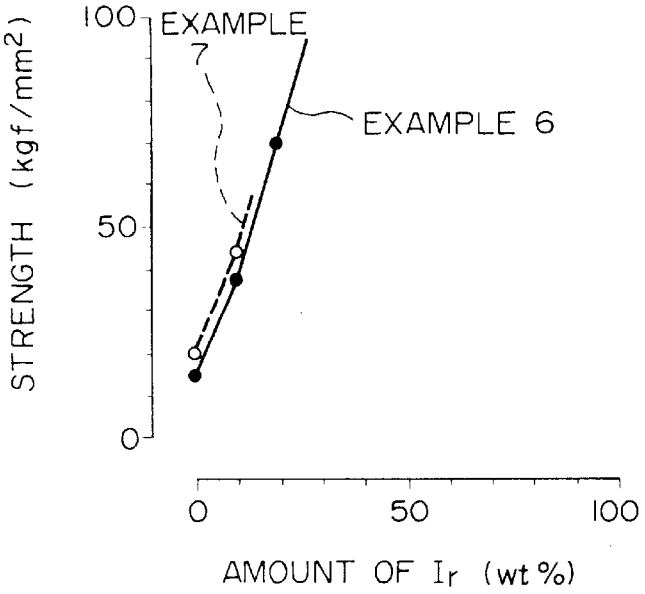
FIG. 8 is a graph indicating the relationship between the amount of iridium contained in the noble metal chips and the strength of the noble metal chips according to Examples 6 and 7.

The results were shown in FIG. 8.

As will be seen from FIG. 7, referring to Example 6, the amount of wear of the noble metal chip containing iridium between 0 and 10% increases gradually. When iridium is added between 10 and 40%, the amount of wear sharply increases, and, when it is further added, the amount of wear again increases gradually.

Referring to Example 7, the amount of wear of the noble metal chip thereof is less than that of Example 6.

As will be clearly seen from FIG. 8, the strength of the noble metal chip becomes greater as the amount of iridium increases. The strength of the noble metal chip of Example 7 is greater than that of Example 6.

Thus, according to FIGS. 7 and 8, it is verified that the noble metal chip has the best wear-resisting properties when 0–10% iridium is added, and that the dispersion-strengthened Pt—Ir alloy used in Example 7 possesses the greatest strength.

EXAMPLE 8

In this example, a durability evaluation of the noble metal chip was performed in order to understand the influence of the relationship between the ratio (t/L) of the thickness t of the noble metal chip to the length L of the narrowed portion and the diameter D of the narrowed portion.

The spark plug of this example employs the noble metal chip and the electrode material having similar compositions to those of Example 1.

The durability evaluation was performed whereby the spark plug of this example was attached to a water-cooled 6-cylinder 2000 cc engine, and the resultant engine was operated at idling for one minute and at 5600 rpm×WOT (the throttle was wide open) for one minute by turns repeatedly for 100 hours. Then, the incidence of cracks of the noble metal chip was examined, thereby evaluating the durability of the noble metal chip.

Figure 9:
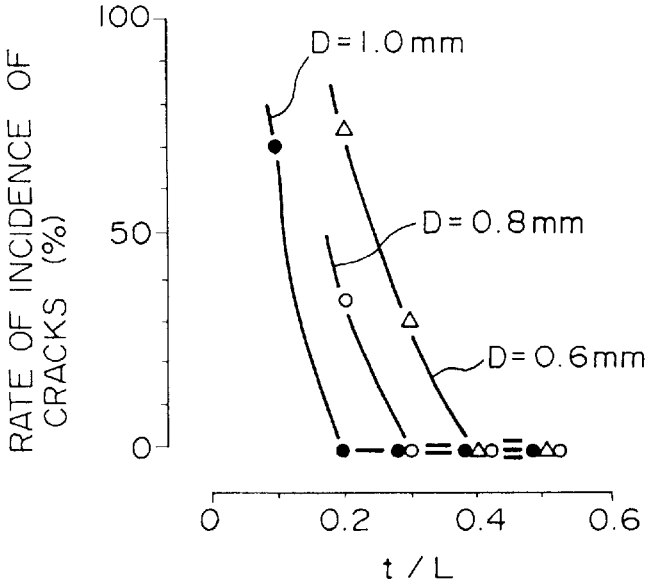
FIG. 9 is a graph showing the relationship between a ratio (t/L) of the thickness t of the noble metal chip to the length L of the narrowed portion and the incidence of cracks of the noble metal chip according to Example 8.

The results are shown in FIG. 9. Referring to FIG. 9, the horizontal axis represents t/L and the vertical axis indicates the incidence of cracks, more specifically, the ratio of the number of the test samples in which a crack occurred at the noble metal chip to the total number of the test samples having the same quality.

As will be seen from FIG. 9, the incidence of cracks becomes less frequent as the diameter D becomes smaller and t/L becomes greater.

Also, the conditions of no occurrence of cracks on the noble metal chips are $t/L \geqq 0.4$ when D is 0.6 mm, $t/L \geqq 0.3$ when D is 0.8 mm, and $t/L \geqq 0.2$ when D is 1.0 mm.

Thus, the limit of the thickness t to such a degree that no cracks occur at the noble metal chip is:

$0.6\ mm \leqq D < 0.8\ mm;\ t/L \geqq 0.4$, that is, $0.4L \leqq t$ $0.8\ mm \leqq D < 1.0\ mm;\ t/L \geqq 0.3$, that is, $0.3L \leqq t$ $1.0\ mm \leqq D \leqq 1.2\ mm;\ t/L \geqq 0.2$, that is, $0.2L \leqq t$

EXAMPLE 9

In this example, the stress corrosion resistance of the electrode material was evaluated.

In the spark plug of this example, the narrowed portion has a length L of 1.5 mm. The diameter D of the narrowed portions was made as 0.6 mm, 0.9 mm and 1.2 mm, and the thickness t of the noble metal chips of the respective diameter portions was varied. Thereafter, the stress corrosion resistance was evaluated.

The other conditions are similar to those of Example 8. The spark plug was used repeatedly as in Example 8, and then evaluated.

Figure 10:
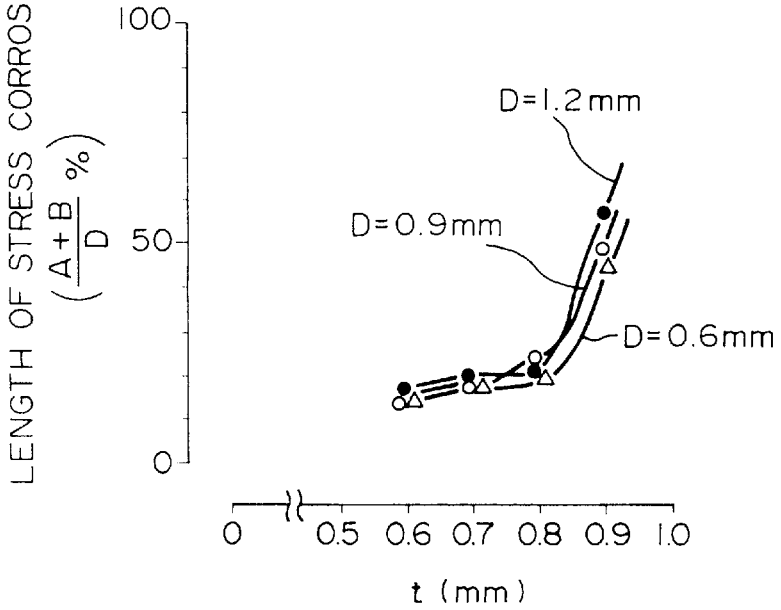
FIG. 10 is a graph showing the relationship between the thickness t of the noble metal chip and the stress corrosion length of an electrode material according to Example 9.

The results are shown in FIG. 10. In the drawing, the horizontal axis represents the thickness t of the noble metal chip and the vertical axis indicates the length of the stress corrosion of the electrode material, which length is calculated by the formula 100×(A+B)+D(%), where (A+B) is a total of the diametrical length of the corroded portion.

As will be seen from FIG. 10, the stress corrosion length of all the narrowed portions having the different diameters D is approximately 20% when the t is 0.8 mm or less. When t is more than 0.8 mm, the stress corrosion length increases sharply. From this fact, it is understood that stress corrosion does not easily occur at the electrode material if t is 0.8 mm or less.

Thus, combining the results of Examples 8 and 9, the following relationship between the diameter D and the ratio t/L is obtained.

$0.4L \leqq t \leqq 0.8$ mm when $0.6$ mm $\leqq D < 0.8$ mm $0.3L \leqq t \leqq 0.8$ mm when $0.8$ mm $\leqq D < 1.0$ mm $0.2L \leqq t \leqq 0.8$ mm when $1.0$ mm $\leqq D \leqq 1.2$ mm

EXAMPLE 10

In this example, a relaxing layer formed of a Pt—Ni alloy was inserted between the noble metal chip and the electrode material in the spark plug used in Example 8, and the resultant spark plug was evaluated as in Example 8.

The Pt—Ni alloy essentially consists of 80% platinum and 20% nickel. The relaxing layer has a thickness S (See FIG. 6) of 0.05 mm and the narrowed portion has a diameter D of 0.6 mm. The narrowed portion having the configuration formed by the thickness S and the diameter D described above is the most susceptible to a harsh temperature atmosphere among other narrowed portions having different configurations according to the present invention.

Figure 11:
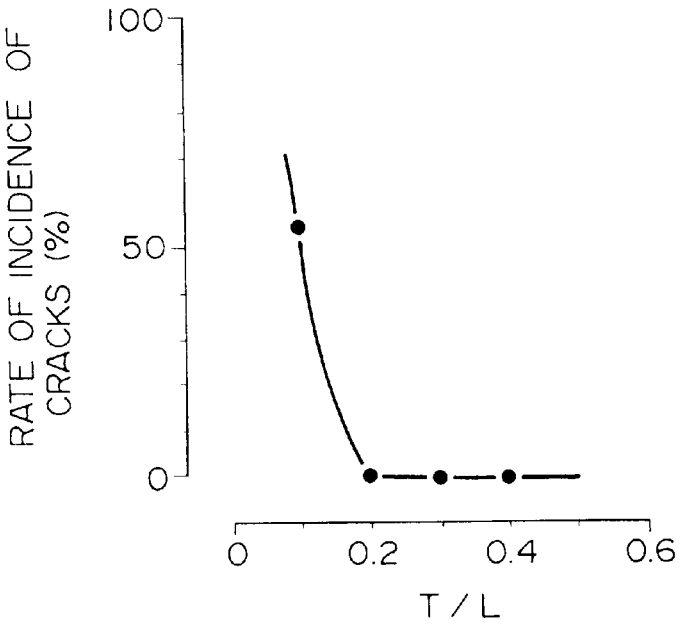
FIG. 11 is a graph indicating the relationship between a ratio (T/L) of the thickness T of a discharge layer to the length L of the narrowed portion and the incidence of cracks of the noble metal chip according to Example 10.

The results are shown in FIG. 11. In the drawing, the horizontal axis represents the ratio (T/L) of the thickness T of the discharge layer to the length L of the narrowed portion and the vertical axis indicates the incidence of cracks of the noble metal chip.

It will be seen from FIG. 11 that a crack occurred at the noble metal chip when T/L was less than 0.2, but when T/L was 0.2 or greater, a crack could not be detected. Hence, the relationship between T and L is $0.2 \leqq T/L \leqq 1$, that is, $0.2L \leqq T \leqq L$.

Moreover, the foregoing evaluation was performed on the spark plug when the relaxing layers essentially consist of 70–90% Pt and 10–30% N; and similar results were obtained.

EXAMPLES 11–14

A similar evaluation to those of Examples 8–10 was performed on the spark plug in these examples by varying the composition of the noble metal chip.

The noble metal chip of these examples utilizes a Pt—Ir alloy or a dispersion-strengthened alloy.

The spark plug of Example 11 employs a noble metal chip formed of 100% Pt, that is, pure platinum.

A 90% Pt—10% Ir alloy is used in Example 12.

A dispersion-strengthened alloy essentially consisting of 98% Pt and 2% zirconia or yttria is used in Example 13.

In Example 14, there is used a dispersion-strengthened alloy consisting of 99.99% Pt—Ir alloy and 0.01% the oxide of zirconia or yttria, the Pt—Ir alloy consists essentially of 90% Pt and 10% Ir.

The other conditions are similar to those of Examples 8–10.

The foregoing evaluation was performed on the spark plugs in Examples 11–14.

Similar results to those of Examples 8–10 were obtained in Examples 11–14.

EXAMPLE 15

In this example, the discharge voltage of the noble metal chip was measured when the spark plug of this example was attached to a vehicle for a practical demonstration.

The spark plug of this example includes a narrowed portion having a diameter D of 0.9 mm and a length L of 1.1 mm, and a noble metal chip having a thickness t of 0.4 mm.

The other conditions are similar to those of Example 1.

A conventional spark plug (PK20R made by Nippondenso Co., Ltd.) was used as a comparative example in comparison with the spark plugs of the present invention. Such a conventional spark plug includes a noble metal chip having a thickness t of 0.3 mm and a narrowed portion having a length L of 0.6 mm and a diameter D of 1.1 mm. The noble metal chip essentially consists of 78% Pt—20% Ir—2% Ni. The other conditions are similar to those of Example 7.

Those spark plugs were attached to a water-cooled 4-cylinder 1500 cc engine used for a vehicle, which ran for 100,000 km, and thereafter, the discharge voltages of the spark plugs according to the present invention and the comparative example were measured.

Figure 12:
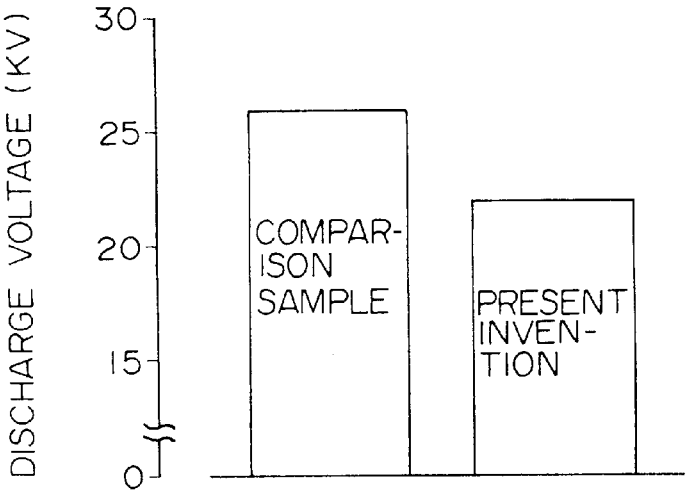
FIG. 12 is a bar graph indicating discharge voltages of spark plugs in Example 15 after the plugs are used over a long period.
Figure 13:
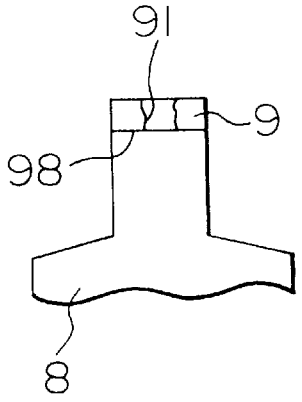
FIG. 13 is a sectional view of an essential portion showing cracks occurring at a noble metal chip in a spark plug of a conventional example.
Figure 14:
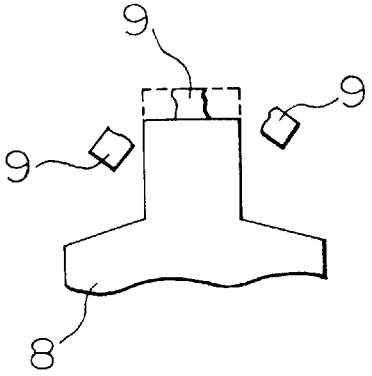
FIG. 14 is a sectional view of an essential portion showing the noble metal chip peeling and falling off in the conventional example.
Figure 15:
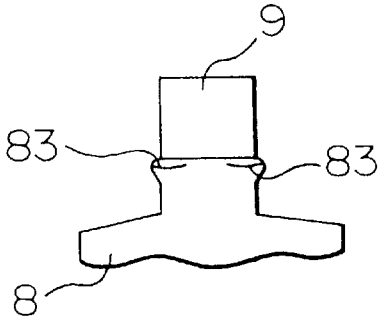
FIG. 15 is a sectional view of an essential portion showing a swelling occurring at a narrowed portion in the conventional example.

The results are shown in FIG. 12.

It will be seen from FIG. 12 that the discharge voltage of the spark plug according to the present invention was approximately 22 KV and that of the comparative example was approximately 27 KV.

Hence, from this fact, it is validated that the spark plug of the present invention offers a great advantage of reducing the discharge voltage even when it is used over a long period. Also, the spark plug of the present invention has good durability.

What is claimed is:

1. A spark plug for an internal combustion engine comprising:

an insulator;

a center electrode supported by said insulator;

a housing secured to an outer periphery of said insulator;

an earth electrode arranged on said housing and facing to said center electrode; and a narrowed portion disposed on a tip of an electrode material of at least one of said center electrode and said earth electrode, said narrowed portion including a projection formed by extending said electrode material and a noble metal chip firmly connected to a terminal end of said projection;

wherein said electrode material is made of a nickel-base heat-resisting alloy, said noble metal chip being made of a platinum-iridium alloy essentially consisting, by weight, of 90–100% Pt and 0–10% Ir, or made of an alloy obtained by dispersing 0.01–2% zirconia or yttria in said Pt—Ir alloy of 98 to 99.99%; a diameter D of said narrowed portion being in a range of 0.6–1.2 mm, a length L of said narrowed portion being in a range of 0.8–1.5 mm, the relationship among a thickness of said noble metal chip t, said diameter D and said length L being made to satisfy $0.4L \leqq t \leqq 0.8$ mm when $0.6$ mm $\leqq D < 0.8$ mm, $0.3L \leqq t \leqq 0.8$ mm when $0.8$ mm $\leqq D < 1.0$ mm, and $0.2L \leqq t \leqq 0.8$ mm when $1.0$ mm $\leqq D \leqq 1.2$ mm.

2. A spark plug for an internal combustion engine comprising:

an insulator;

a center electrode supported by said insulator;

a housing secured to an outer periphery of said insulator;

an earth electrode arranged on said housing and facing to said center electrode; and a narrowed portion disposed on a tip of an electrode material of at least one of said center electrode and said earth electrode, said narrowed portion including a projection formed by extending said electrode material and a discharge layer firmly connected to a top end of said projection;

wherein said discharge layer is provided with a noble metal chip arranged on a discharging side and a relaxing layer arranged on another side of said projection;

said electrode material being made of a nickel-base heat-resisting alloy, said noble metal chip being made of a Pt—Ir alloy essentially consisting, by weight, of 90–100% Pt and 0–10% Ir, or made of an alloy obtained by dispersing 0.01–2% zirconia or yttria in said Pt—Ir alloy of 98 to 99.99%;

said relaxing layer being made of a Pt—Ni alloy essentially consisting, by weight, of 70–90% Pt and 10–30% Ni; and a diameter D of said narrowed portion being in a range of 0.6–1.2 mm, and a length L of said narrowed portion provided with said discharge layer being in a range of 0.8–1.5 mm, a thickness S of said relaxing layer being not less than 0.05 mm, and the relationship between a thickness T of said discharge layer and said length L of said narrowed portion being $0.2L \leqq T \leqq L$.

* * * * *